US006399845B1

(12) United States Patent
Raulo et al.

(10) Patent No.: US 6,399,845 B1
(45) **Date of Patent: *Jun. 4, 2002**

(54) PROCESS FOR PRODUCING HIGH GRADE DIESEL FUEL

(75) Inventors: Pirkko Raulo; Outi Piirainen, both of Helsinki; Juha-Pekka Aalto, Porvoo, all of (FI)

(73) Assignee: Fortum Oil & Gas Oy, Espoo (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/424,485

(22) PCT Filed: May 28, 1998

(86) PCT No.: PCT/FI98/00447

§ 371 (c)(1),
(2), (4) Date: Nov. 23, 1999

(87) PCT Pub. No.: WO98/56876

PCT Pub. Date: Dec. 17, 1998

(30) Foreign Application Priority Data

May 29, 1997 (FI) ..... 972273

(51) Int. Cl.[7] ..... C10G 45/64; C07C 5/27
(52) U.S. Cl. ..... 585/739; 585/266; 208/142
(58) Field of Search ..... 585/739, 740, 585/266, 276; 208/27, 137

(56) References Cited

U.S. PATENT DOCUMENTS

| | | | | |
|---|---|---|---|---|
| 3,894,938 A | | 7/1975 | Gorring et al. | |
| 4,176,050 A | | 11/1979 | Chen et al. | |
| 4,181,598 A | | 1/1980 | Gillespie et al. | |
| 4,222,855 A | | 9/1980 | Pelrine et al. | |
| 4,229,282 A | | 10/1980 | Peters et al. | |
| 4,428,865 A | | 1/1984 | Oleck et al. | |
| 4,440,871 A | | 4/1984 | Lok et al. | |
| 4,501,926 A | | 2/1985 | LaPierre et al. | |
| 4,689,138 A | | 8/1987 | Miller | |
| 4,859,311 A | | 8/1989 | Miller | |
| 4,960,504 A | | 10/1990 | Pellet et al. | |
| 5,149,421 A | | 9/1992 | Miller | |
| 5,612,273 A | * | 3/1997 | Prada et al. | 502/313 |
| 5,817,595 A | * | 10/1998 | Tejada et al. | 502/313 |

FOREIGN PATENT DOCUMENTS

| | | |
|---|---|---|
| EP | 095303 B1 | 4/1986 |
| EP | 155822 B1 | 12/1990 |
| EP | 512652 B1 | 8/1995 |
| EP | 378887 B1 | 9/1995 |
| WO | 95/10578 | 4/1995 |
| WO | 95/28459 | 10/1995 |
| WO | 96/18705 | 6/1996 |

* cited by examiner

*Primary Examiner*—Bekir L. Yildirim
(74) *Attorney, Agent, or Firm*—Birch Stewart Kolasch Birch, LLP.

(57) ABSTRACT

Process for isomerisation of a hydrocarbonaceous feedstock substantially boiling in the gasoline range which feedstock comprises linear paraffins having at least five carbon atoms wherein the feedstock is contacted in the presence of hydrogen at elevated temperature and pressure with a catalyst comprising in combination platinum (Pt) and palladium (Pd) each in metallic form supported on an acidic amorphous alumina or molecular sieve, and isomerised hydrocarbons preprared by the process.

17 Claims, No Drawings

PROCESS FOR PRODUCING HIGH GRADE DIESEL FUEL

This application is the national phase under 35 U.S.C. §371 of PCT International Application No. PCT/FI98/00447 which has an International filing date of May 28, 1998 which designated the United States of America.

The present invention relates to chemical industry, especially to petroleum refining. Particularly, the object of the invention is a process for producing high grade middle distillate without substantially altering the distillation range. The product can for instance be used as a diesel fuel.

A low content of sulfur and aromatic compounds, a high cetane number, and an adequate density are among the particular properties of a high grade diesel fuel to be mentioned.

The increasingly strick environmental requirements, in particular regulations limiting the exhaust emissions from the fuels are continuously increasing the demands made on the properties of a high grade fuel. Less polluting diesel fuels are badly needed. Lowering the content of sulfur and aromatic compounds in diesel fuels has an influence on the particle emission from a diesel engine. Further, lowering the amount of aromatic compounds and increasing the cetane number reduce emissions of nitrogen oxides, and a high cetane number seems to reduce the formation of smoke at low temperatures, and particle emissions. In addition, lowering the content of polynuclear aromatic compounds reduces the health hazards associated to diesel exhaust gases. In particular, the emissions from a diesel engine are significant at low temperatures, for instance in wintertime in countries where the temperature remains an extended period of time under 0° C., or even less. Such conditions are very demanding for a diesel engine.

The density of a diesel fuel and accordingly the energy content in a unit volume thereof should remain constant throughout the year to ensure the smooth runnig of the engine to reduce emissions therefrom.

Being heavier, the low temperature properties of a diesel fuel are far more important than those of gasoline. In a cold climate such low temperature properties of a diesel fuel should be good. The diesel fuel must remain liquid in all conditions of use, and it may not form precipitates in the fuel feeding devices. The low temperature properties are evaluated by determining the cloud and pour points, as well as the filterability of the fuel. Favourable low temperature properties of a diesel fuel, and a high cetane number are somewhat contradictory. Normal paraffins have high cetane numbers, but poor low temperature properties. On the other hand, aromatics have superior low temperature properties, but low cetane numbers.

Several liquid hydrocarbon fractions contain relatively high amounts of aromatics. Various methods for reducing the content of aromatic compounds and therefore increasing the cetane number are familiar to those skilled in the art. One of these methods is hydrogenation. In hydrogenation the middle distillate is treated with hydrogen at an elevated pressure in the presence of a hydrogenation catalyst. Hereby the cetane number of the diesel fuel increases. In comparison to the feed, the low temperature properties of the fuel are not essentially changed.

On the other hand, there are processes for selectively cracking off normal paraffins that lead to poor properties at low temperatures. In these processes the catalyst used is normally a zeolite with a suitable pore size. Only normal paraffins with straight chains, or paraffins with moderately branched chains can penetrate into the pores. As examples of such zeolites can be mentioned ZSM-5, ZSM-11, ZSM-12, ZSM-23, and ZSM-35, the use thereof being described in U.S. Pat. Nos. 3,894,938, 4,176,050, 4,181,598, 4,222,855, and 4,229,282. With normal paraffins removed, the low temperature properties of the product are improved, but the cetane number is lowered and the content of aromatic compounds is usually increased. Especially heavy feeds are treated with such a process with which waxy components are desired not only to be removed, but also to be converted to other, more valuable materials. Moreover, this process is applicable to lighter middle distillate feeds, as is disclosed in PCT Patent Publication WO95/10578. The said publication relates to a method for converting a hydrocarbon feed containing waxes, and at least 20% by weight thereof boiling above 343° C., to a middle distillate product with a lower wax content. According to this method the feed is contacted in the presence of hydrogen with a hydrocracking catalyst containing a carrier, at least one hydrogenation metal component selected from the metals of the group(s) VIB and/or VIII of the periodic table of the elements, and a zeolite with a large pore size, the diameter of the pores being between 0.7 and 1.5 nm, and then the hydrocracked product is contacted in the presence of hydrogen with a catalyst for wax removal containing a crystalline molecular sieve with a medium pore size selected from metallosilicates and silicoaluminophosphates. The method comprises both a hydrocracking step and a step for wax removal using respectively a different catalyst.

U.S. Pat. No. 5,149,421 discloses a process for isomerizing a lubricating oil with a catalyst combination containing a silicoaluminophosphate molecular sieve as well as a zeolite catalyst. Further, U.S. Pat. No. 4,689,138 describes a method for wax removal from lubricating oils and from middle distillates. The hydrogenation of aromatic compounds is not discussed in this patent. The catalyst was a SAPO-11 to which the hydrogenating metal was added in an unusual way, namely directly to the crystallization solution of the molecular sieve.

In U.S. Pat. No. 4,859,311 wax is removed from a hydrocarbon feed boiling above 177° C., hereby converting the hydrocarbons at least partially and selectively to non-waxy hydrocarbons with a lower molecular weight. Essentially, also this patent relates to the production of a lubricating oil.

Moreover, there are processes for removing wax from distillates used as starting feed materials, by isomerizing, the waxy paraffins without any substantial cracking, such as described in the patent FI 72 435. Here, the typical feed materials are hydrocarbons boiling above 180° C. ($>C_{10}$). Hereby the low temperature properties of the product are improved in comparison with the feed.

Wax removal is also carried out using, methods in which heavy normal paraffins are removed with a solvent to improve the low temperature properties of the product. Surprisingly, it has now been found that it is possible to produce, by using a single treatment and middle distillates as the feed, a high grade diesel component with superior low temperature properties and a low content of aromatic compounds, without significantly changing the cetane number of the product. An optimal balance between the cetane number, the content of aromatic compounds and the low temperature properties is attained in the diesel fuel by treating these distillates in a specific way.

Accordingly, one object of the present invention is a process for producing from a middle distillate a high grade diesel fuel with superior low temperature properties and a low content of aromatic compounds. Another object of the invention is to provide a process for producing diesel fuel that leaves the cetane number of the product essentially unchanged even though normal paraffins are isomerized to isoparaffins with lower cetane numbers. The cetane features lost with the isomerization of the paraffins are recovered by hydrogenating the aromatics. In addition, the treatment can cause opening of ring structures and minor cracking. Due to this cracking the product may also comprise lighter isoparaffins than the feed, these lighter isoparaffins having superior low temperature properties as well as high cetane numbers.

The present invention relates to a process for producing from a hydrocarbon feed as the starting material, especially from a middle distillate a product suitable as a diesel fuel with improved low temperature properties and a low content of aromatic compounds.

The invention is characterized in that the feed material is contacted in a single reaction step, in the presence of hydrogen, and at an elevated temperature and pressure, with a bifunctional catalyst containing a hydrogenating metal component in addition to a molecular sieve and a carrier. The catalyst ensures the removal of aromatics and the simultaneous isomerization of paraffins.

A suitable isomerizing component in the method of this invention is a molecular sieve, used in an amount of 20–90 wt-%, preferably 65–80 wt-%, relative to the total weight of the catalyst. For instance, a crystalline aluminosilicate, or a silicoaluminophosphate may be used as a molecular sieve.

The method of the invention provides a diesel fuel having a very low total content of aromatics as well as a very low total content of substances consisting of polynuclear aromatic compounds extremely hazardous to health. The use of the diesel fuel according to the invention gives rise to very low levels of emissions detrimental to the environment, comprising for instance sulfur, nitrogen oxides and particles, and to a very weak formation of smoke at low temperatures. The fuel contains very little, if any, sulfur. The process being versatile concerning the feed, the end point of the distillation of the diesel fuel product may be adjusted to a suitably heavy range without adversely affecting the low temperature properties of the product. Further, the seasonal variation of the density and viscosity of a diesel fuel and thus environmental impact of exhaust emissions are reduced.

Starting Feed Material

The feed used according to the invention is a middle distillate. By middle distillate is understood a mixture of hydrocarbons boiling in the range of 150 to 400° C. Accordingly, as examples of useful starting feed materials may be mentioned solvents, petrols, as well as light and heavy gas oils. The middle distillate may be for example distillated from such materials as crude oil, or the products of a catalytic cracking or hydrocracking. Concerning the hydrocarbon stream fed to the aromatics removal and simultaneous isomerization step according to the invention, the sulfur content thereof should be below 1000 ppm, and the nitrogen content less than 100 ppm. Preferably, the sulfur concentration is less than 100 ppm and the nitrogen concentration is less than 10 ppm.

General Process

According to the invention, the aromatics removal and the simultaneous isomerizing treatment of the middle distillate is accomplished in the presence of hydrogen and a catalyst, at an elevated temperature and pressure. The reaction temperature may vary between 250 and 500° C., the pressure being at least 10 bar, the hydrogen feed being at least 100 Nl/l, and the liquid hourly space velocity (LHSV) being between 0.5 and 10 $h^{-1}$. The following conditions are preferable:

LHSV 0.5–3 $h^{-1}$ temperature 300–400° C., pressure 50–80 bar and hydrogen flow 200–500 Nl/l.

Catalyst

In the process of the invention the catalyst may comprise any commercial catalyst for wax removal. The essential component of a catalyst for wax removal is a crystalline molecular sieve with a medium pore size. The molecular sieve may be selected from zeolites and silicoaluminophosphates. Useful zeolites include β-zeolite, and zeolites ZSM-11, ZSM-22, ZSM-23, and ZSM-35. The said zeolites are used for instance in the following patents relating to wax removal: FI 72 435, U.S. Pat. No. 4,428,865 and European Patent Publication Nos. 0,378,887 and 0,155,822.

Useful silicoaluminophosphates include SAPO-11, SAPO-31, SAPO-34, SAPO-40, and SAPO-41 that may be synthetized according to the patent U.S. Pat. No. 4,440,871. These silicoaluminophosphates were used as isomerization catalysts in such publications as U.S. Pat. No. 4,689,138, U.S. Pat. No. 4,960,504, and WO 95/10578.

In addition, the catalyst of the invention comprises one or more metal(s) as a hydrogenation/dehydrogenation component. These metals typically belong to the group VIb, or VIII of the periodic table of the elements. Preferably, the metal used is platinum, the amount thereof being 0.01–10 wt-%, preferably 0.1–5 wt-%.

Further, the catalyst comprises as a carrier an inorganic oxide. Known carrier materials include the oxides of aluminium and silicon, as well as mixtures thereof. The relative amounts of the molecular sieve and the carrier may vary widely. The proportion of the molecular sieve in the catalyst is usually between 20 and 90 wt-%. Preferably, the catalyst mixture contains the molecular sieve in an amount of 65–80 wt-%.

If desired, the middle distillate used as the feed may be hydrogenated to reduce the content of sulfur and nitrogen compounds thereof to a suitable level. Any known technology for lowering the sulfur and nitrogen content of a middle distillate may be used as the procedure for sulfur and nitrogen removal. Hydrogenation under hydrogen pressure and by means of a catalyst is normally used to this end to convert the organic sulfur and nitrogen compounds respectively to hydrogen sulfide and ammonia.

The treatment for sulfur and nitrogen removal may optionally be carried out in view of a more advantageous product distribution and an extended operation time.

Any commercially available CoMo and/or NiMo catalyst may be used as the catalyst for sulfur and nitrogen removal. Usually, although not necessarily, the catalyst is pre-sulfided to improve the activity thereof. Without such a pre-sulfiding treatment the initial activity for desulfurization of the catalyst is low. Any process conditions generally known for sulfur removal may be used, such as:

LHSV 0.5–20 $h^{-1}$, temperature 250–450° C., pressure >10 bar, hydrogen flow >100 Nl/l.

The following conditions are preferable:

LHSV 1.0–5.0 $h^{-1}$, temperature 300–400° C., pressure 30–50 bar, hydrogen flow 150–300 Nl/l.

From this desulfurization step the product, free from hydrogen sulfide, ammonia, as well as lighter hydrocarbons, is fed to the step for isomerization and simultaneous removal of aromatics according to the present invention.

The bifunctional catalyst for isomerization and wax removal has an acid function, as well as a hydrogenating function ideally in a good balance with one another. For instance, zeolite catalysts are generally modified by removing aluminium from the crystalline structure, such as by extracting with hydrochloric acid as described in the patent publication EP 0,095,303, or using a water vapor treatment according to the patent publication WO 95/28459, to reduce the acidity, and thus the amount of any unselective reactions.

In the isomerization of the paraffins of the middle distillates the cracking thereof to gasoline and gaseous products is an undesirable reaction to be limited. This may not only be achieved with a known technique by reducing acidic sites in the catalyst, but also, according to our observation, by controlling the nitrogen content of the feed. An excessive nitrogen content lowers the activity of the catalyst, and thus the removal thereof to a certain level is desirable. On the other hand, a completely nitrogen free feed is not always preferable, since the catalyst might then be too acidic. By controlling the nitrogen content of the feed to the isomerization the product distribution may be adjusted to produce the desired diesel component at as high levels as possible, and to improve the selectivity of the isomerization. Preferably, the control is carried out by using organic nitrogen compounds that decompose in the isomerization conditions to form ammonia. This ammonia passivates the acidity of the catalyst, leading to the desired result. The passivation required by various kinds of zeolites and molecular sieves, respectively, is of course different. For instance, with the SAPO molecular sieves the passivation may be expected to be less significant that with zeolites in general. The passivation is not needed if the nitrogen content of the feed is sufficiently high.

The passivation may be carried out by using ammonia, as well as organic nitrogen compounds, preferably aliphatic amines. For instance, tributyl amine (TBA) is preferable since it decomposes easily to form the ammonia needed. The correct nitrogen content of the feed may also be achieved by controlling the degree of the nitrogen removal before the isomerization.

The diesel fuel provided by the process of the present invention is free of sulfur, or contains very low levels thereof, thus being ecologically very acceptable. Further, it is particularly suitable to the demanding low temperature conditions. Since the process is versatile in view of the feed, the end point of the distillation of the diesel fuel product may be adjusted to a suitably heavy range without adversely affecting the low temperature properties thereof. Further. the seasonal variations of the density and viscosity of the diesel fuel, and thus the polluting impact on the environment of exhaust emissions therefrom are reduced.

This combined method for isomerization and simultaneous aromatics removal produces as a by-product low levels of lighter hydrocarbons that may be removed from the diesel product stream by distillation, and conducted further to an optional processing.

The invention is now illustrated with reference to the following working examples.

EXAMPLE 1

The molecular sieve SAPO-11, used as a component of the catalyst, was synthetized from the following starting materials:

TABLE 1

The starting materials for the SAPO-11 synthesis

| Starting material | Grade | Quantity |
|---|---|---|
| Aluminium isopropoxide | Aldrich | 3.000 kg |
| Silica | Cab-O-Sil, M-5, Fluka | 0.265 kg |
| Dipropylamine | Aldrich, D = 0,738 | 0.547 kg |
| Ortho-phosphoric acid | 85% | 1.694 kg |
| Water | Demineralized | 2.652 kg |

The crystallization of the SAPO-11 was carried out in a Parr autoclave, at 200±5° C., with gentle stirring (50 rpm) for 48 hours. After filtering and washing the product was dried at 150° C. To calcinate the product, the temperature was raised slowly to 500° C., and then the product was held at 500–550° C. for 12 hours. The $SiO_2/Al_2O_3$ ratio of the molecular sieve was 0.58.

The catalyst was prepared by mixing the SAPO-11 and a Ludox AS-40 solution to obtain a $SiO_2$-content of 20 wt-% after drying and calcination. Platinum was added with the pore filling method using an aqueous $Pt(NH_3)_4Cl_2$ salt solution to achieve a final platinum content of 0.5 wt-%. By analysis the platinum content was 0.48 wt-%, and the dispersion thereof was 26%.

EXAMPLE 2

The catalyst prepared in Example 1 was used in a combined treatment for aromatics removal and isomerization of an oil feed. Before the treatment the gas oil feed from a crude distillation was freed from sulfur and nitrogen. The analysis data of the feed is summarized below in Table 2.

TABLE 2

The analysis data of the oil feed

| | |
|---|---|
| Density 15° C. (kg/m$^3$) | 853.5 |
| Viscosity 40° C. (mm$^2$/s) | 4.9 |
| Sulfur (mg/kg) | 8 |
| Nitrogen (mg/l) | 10 |
| Br index (–) | 460 |
| Cloud point (° C.) | 6 |
| Filterability (° C.) | 3 |
| Distillation (° C.); IBP | 215 |
| 5 vol-% (° .C) | 250 |
| 10 vol-% (° C.) | 268 |
| 50 vol-% (° C.) | 310 |
| 90 vol-% (° C.) | 349 |
| 95 vol-% (° C.) | 359 |
| EP (° C.) | 370 |
| Cetane number | 58 |
| Cetane index | 53 |
| Aromatics (wt-%) | 25 |
| N-paraffins (wt-%) | 20 |
| I-paraffins (wt-%) | 16 |

The treatment of the oil feed was carried out in a microreactor using the following conditions:

WHSV 2.5 h$^{-1}$, pressure 40 bar and temperature 350° C., or pressure 70 bar and temperature 370° C., the quantity of the catalyst being 6 grams, and the $H_2$-flow 7 liters per hour.

Flow expressed as LHSV means volume per catalyst volume and as WHSV means weight per catalyst weight. LHSV 1 corresponds to approx. WHSV 1.4 and WHSV 1 corresponds to approx. LHSV 0.7.

The results of the combined treatment for aromatics removal and simultaneous isomerization of the oil feed specified above in Table 2 are summarized in Table 3.

TABLE 3

| Sample | Cloud point ° C. | Pour point ° C. | Filter-ability ° C. | Aro-matics. vol-% | Conversion of $C_{11}^+$ n-paraffins wt-% | Gas-oline. wt-% |
|---|---|---|---|---|---|---|
| Feed | +6 | +3 | +3 | 25.5 | | 2.1 |
| 350° C./40 bar | −4 | −12 | −7 | 19.1 | 25 | 2.7 |
| 370° C./70 bar | −20 | −30 | −24 | 11.6 | 52 | 4.5 |
| 370° C./70 bar (5% of the lightest product cut off) | −19 | −30 | −22 | | | |

As the microreactor test results in Table 3 show, at the pressure of 70 bar and temperature of 370° C., the pour point was improved from +3° C. to −30° C., and the total aromatics (IP391) content was simultaneously lowered from 25.5 vol-% to 11.6 vol-%. The yield of gasoline was in these conditions only about 5 wt-%, the removal thereof effecting in no significant way on the low temperature properties.

EXAMPLE 3

In this example a catalyst comprising $Al_2O_3$ as a carrier was prepared from the SAPO 11 molecular sieve obtained in Example 1 in such a manner that the $Al_2O_3$ content of the catalyst was 20 wt-% after drying and calcination. The Catapal B aluminium oxide was first peptidized with a 2.5 wt-% acetic acid solution, and the catalyst was shaped using an extruder. Platinum was added in the same manner as in Example 1. By analysis the platinum content was 0.54 wt-%, the dispersion thereof being 65%.

EXAMPLE 4

The catalyst prepared in Example 3 was used, in the same manner as the catalyst of Example 1 in the combined treatment for aromatics removal and simultaneous isomerization of the oil feed specified in table 2.

The results of the combined treatment for aromatics removal and simultaneous isomerization of the oil feed according to the! table 2, using the catalyst comprising A1203 as a carrier, obtained in Example 3, are presented in Table 4.

TABLE 4

| Sample | Cloud point ° C. | Pour point ° C. | Filter-ability ° C. | Aro-matics. vol-% | Conversion of $C_{11}^+$ n-paraffins wt-% | Gas-oline. wt-% |
|---|---|---|---|---|---|---|
| Feed | +6 | +3 | +3 | 25.5 | | 2.1 |
| 350° C./40 bar | −16 | −24 | −19 | 12.8 | 47 | 4.1 |
| 370° C./70 bar | −29 | −33 | −32 | 9.5 | 63 | 5.9 |

As shown by the results in Table 4, at the pressure of 70 bar and temperature of 370° C. the pour point was improved from +3° C. to −33° C., the total aromatics content being simultaneously lowered from 25.5 vol-% to 9.5 vol-%. The product contained gasoline only about 6 wt-%, the gasoline content of the feed being 2.1 wt-%.

EXAMPLE 5

The process of the invention was also tested by using a pilot scale reactor equipment. The reactor was packed with a single catalyst bed comprising a single catalyst. The oil feed according to Table 2 of Example 2 was contacted in the following conditions with the catalyst obtained as described in Example 1:

Pressure 40 and 70 bar, WHSV 1.0 and 2.5 $h^{-1}$, temperature 340–370° C. and hydrogen to hydrocarbon ratio 300 Nl/l.

The minor quantity of gasoline formed in the process was distilled from the product. The analysis data of the middle distillate obtained are presented below in Table 5.

TABLE 5

The analysis data of the middle distillate obtained by using a pilot scale reactor equipment

| Parameter/unit | | | | | |
|---|---|---|---|---|---|
| Pressure (bar) | | 70 | 70 | 40 | 70 |
| WHSV ($h^{-1}$) | | 1.0 | 1.0 | 1.0 | 2.5 |
| Temperature (° C.) | | 339 | 369 | 368 | 370 |
| Analysis | / Unit | | | | |
| Density (15° C.) | / $kg/m^3$ | 842.8 | 841.4 | 849.9 | 848.6 |
| Viscosity 40° C. | / $mm^2/s$ | 5.01 | 4.64 | 4.79 | 5.02 |
| Sulfur | / mg/kg | 2.6 | 0.7 | 0.4 | 0.4 |
| Br-index | / | 91 | 77 | 186 | 168 |
| Cloud point | / ° C. | −5 | −32 | −27 | −7 |
| Filterability | / ° C. | −5 | −31 | −28 | −6 |
| Distillation IBP | / ° C. | 243 | 233 | 236 | 238 |
| 5 vol-% | / ° C. | 262 | 252 | 254 | 260 |
| 10 vol-% | / ° C. | 270 | 261 | 264 | 269 |
| 50 vol-% | / ° C. | 307 | 303 | 305 | 307 |
| 90 vol-% | / ° C. | 346 | 345 | 345 | 347 |
| 95 vol-% | / ° C. | 356 | 358 | 361 | 358 |
| EP | / ° C. | 366 | 364 | 371 | 368 |
| Cetane number | / | 59.2 | 57.9 | 53.4 | 57.0 |
| Cetane index | / | 57 | 57 | 54 | 55 |
| Aromatics | / wt-% | 8.6 | 13.4 | 23.3 | 20.6 |
| N-paraffins | / wt-% | 16 | 8 | 9 | 17 |
| I-paraffins | / wt-% | 18 | 33 | 32 | 18 |

The results presented above in Table 5 show the isomerization of the product, the cloud point thereof being lowered from +6° C. to −32° C. Simultaneously, the content of aromatics was clearly lowered, from the value of 25.1 wt-% of the feed to 13.4 wt-% and even to 8.6 wt-% at a lower temperature.

EXAMPLE 6

The isomerization of a hydrogenated Tall Oil Fatty Acid (TOFA) was tested without and with the addition of organic nitrogen (TBA). The TOFA feed comprised about 84 wt-% of n-$C_{17}$+n-$C_{18}$ paraffins. The TBA was added to the final nitrogen content of 5 mg/l of the feed.

The catalyst used in this example was prepared from the molecular sieve SAPO-11 with the Si to Al ratio of 0.22, by adding $Al_2O_3$ in an amount of 20 wt-%. After the calcination the catalyst was impregnated with an aqueous $Pt(NH_3)_4Cl_2$ solution using the pore filling method. The final catalyst comprised 0.48 wt-% of platinum, the dispersion thereof being 88%.

The conditions for testing were as follows:

Pressure 50 bar, WHSV 3 $h^{-1}$, hydrogen to hydrocarbon ratio about 600 l/l and temperature 355° C. and 370° C.

The results of the isomerization of the hydrogenated TOFA are presented below in Table 6.

TABLE 6

The isomerization of the hydrogenated TOFA

| Property | Feed | TOFA/ 355° C. | TOFA/ 370° C. | TOFA + N/ 355° C. | TOFA + N/ 370° C. |
|---|---|---|---|---|---|
| Gas (<$nC_5$), wt-% | 0.0 | 0.1 | 3.4 | 0.1 | 0.1 |
| Gasoline ($nC_5$ < 174° C.) wt-% | 0.4 | 4.6 | 13.0 | 4.2 | 5.4 |
| Middle distillate (>174° C.), wt-% | 99.6 | 95.3 | 83.6 | 95.7 | 94.5 |
| (n-$C_{17}$ + n-$C_{18}$) converted, wt-% | | 83.6 | 93.2 | 60.5 | 89.3 |
| Isomerization selectivity of the middle distillate fraction, wt-% | | 80.2 | 68.2 | 76.6 | 79.4 |

At a lower temperature the nitrogen passivation has a lowering effect on the conversion level, whereas at a higher temperature and at a higher conversion level the passivated catalyst acts more selectively than the unpassivated catalyst. When using the feed containing nitrogen the quantity of the isomers of the diesel range was 79.4% calculated from the weight of the converted product, the conversion of n-$C_{17}$+ n-$C_{18}$ paraffins being 89.3 wt-%. The superior selectivity is also shown by the amounts of gas and gasoline.

EXAMPLE 7

The passivating effect of organic nitrogen was also tested using a pilot scale reactor equipment already described in Example 5. The oil feed according to Table 2 of Example 2 and a similar oil feed, yet free of organic nitrogen were contacted in the following conditions with the catalyst prepared in Example 1:

Pressure 70 bar, WHSV 1.0 $h^{-1}$, temperature 370° C. and hydrogen to hydrocarbon ratio 300 l/l.

The results are presented in Table 7.

TABLE 7

The passivating effect of organic nitrogen

| Property | Feed | Without nitrogen | With nitrogen |
|---|---|---|---|
| Gasoline ($nC_4$ < 174° C.), wt-% | 2.1 | 12.7 | 8.6 |
| Middle distillate (> 174° C.), wt-% | 97.9 | 87.3 | 91.4 |
| ($n-C_{11}^{+}$) converted, wt-% | | 64.6 | 63.7 |
| Isomerization selectivity of the middle distillate fraction, wt-% | | 24.6 | 53.1 |

The catalyst passivated with organic nitrogen acts far more selectively than the unpassivated counterpart. The degree of the undesirable cracking clearly increases without passivation, shown by the higher quantity of gasoline.

EXAMPLE 8

In this example a catalyst was prepared from a beta-zeolite with a Si/Al ratio between 11 and 13, by adding Ludox AS-40 to adjust the $SiO_2$ content of the catalyst to 35 wt-% after the calcination. After the shaping and calcination the catalyst was impregnated with an aqueous $Pt(NH_3)_4Cl_2$ solution using the pore filling method. The final catalyst comprised 0.45 wt-% of platinum.

The isomerization of a hydrogenated Tall Oil Fatty Acid (TOFA) was tested without, and with the addition of organic nitrogen (TBA). The TOFA feed comprised about 80 wt-% of n-$C_{17}$+n-$C_{18}$ paraffins. TBA was added to the final nitrogen content of 5 mg/l of the feed.

The conditions for testing were:

Pressure: 50 bar

WHSV: 3 $h^{-1}$

Hydrogen to hydrocarbon ratio: about 600 l/l

Temperature: 300° C.

The results are presented in Table 8.

TABLE 8

| Property | Feed | TOFA | TOFA + 5 mg/l N |
|---|---|---|---|
| Gas (< n $C_5$), wt-% | 0.0 | 6.4 | 2.2 |
| Gasoline (n $C_5$ < 174° C.), wt-% | 0.5 | 22.0 | 13.5 |
| Middle distillate (> 174° C.), wt-% | 99.5 | 71.6 | 84.3 |
| (n-$C_{17}$ + n-$C_{18}$ converted, wt- % | | 86.2 | 80.3 |
| Isomerization selectivity of the middle distillate fraction, wt- % | | 49.2 | 62.5 |

The passivated catalyst acts more selectively than its unpassivated counterpart, which is also shown by the quantities of gas and gasoline. The quantity of the desired middle distillate fraction obtained with the passivated catalyst was about 13 wt-% units more, the conversion level being slightly lower.

What is claimed is:

1. A process for producing a middle distillate suitable as a diesel fuel, with improved low temperature properties and a low content of aromatic compounds, from a hydrocarbon feed as a starting material which comprises contacting said feed material in a single reaction step, in the presence of hydrogen, and at an elevated temperature and pressure, with a bifunctional catalyst which comprises:

a hydrogenating metal component which consists of one hydrogenating metal;

a molecular sieve; and a carrier for the simultaneous removal of aromatics and isomerization of paraffins.

2. The process according to the claim 1, characterized in that the molecular sieve comprises 20–90 wt-%, preferably 65–80 wt-% of the total weight of the catalyst.

3. The process according to the claim 1 or 2, characterized in that the molecular sieve used as the isomerizing component comprises crystalline aluminosilicate.

4. The process according to the claim 1 or 2, characterized in that the molecular sieve used as the isomerizing component comprises crystalline silicoaluminophosphate.

5. The process according to the claim 4, characterized in that the silicoaluminophosphate comprises SAPO-11.

6. The process according to any of the above claims, the catalyst system contains as the hydrogenating/dehydrogenating component a metal selected from the metals belonging to the group VIII of the periodic table of the elements.

7. The process according to the claim 6, characterized in that the metal comprises platinum.

8. The process according to the claim 6 or 7, characterized in that the hydrogenating/dehydrogenating component comprises 0.01–10 wt-%, preferably 0.1–5 wt-% of the total weight of the catalyst.

9. The process according to claim 1, characterized in that the carrier is selected from the group consisting of silica and alumina, or the mixtures thereof.

10. The process according to claim 1, characterized in that it is carried out at a temperature between 250 and 500° C., at a pressure above 10 bar, the hydrocarbon feed LHSV being less than 10 $h^{-1}$, and the hydrogen flow being more than 100 Nl/l.

11. The process according to claim 1, characterized in that the boiling range of the hydrocarbon feed used as the starting, material is 150–400° C.

12. The process according to claim 1, characterized in that the product distribution may be adjusted by controlling the degree of the nitrogen removal preceeding the isomerization, or if necessary by adding to the feed an organic nitrogen compound to adjust the nitrogen concentration thereof to a value between 1 and 100 ppm.

13. The process according to claim 1, characterized in that the product distribution may be adjusted by controlling the degree of the nitrogen removal preceeding the isomerization, or if necessary by adding to the feed an organic nitrogen compound to adjust the nitrogen concentration thereof to a value between 2 and 20 ppm.

14. The process according to claim 1, characterized in that the product distribution may be adjusted by controlling the degree of the nitrogen removal preceeding the isomerization, or if necessary by adding to the feed an organic nitrogen compound selected from aliphatic amines.

15. The process according to claim 1, wherein the aromatic compound content of the middle distillate is at least 50% less than the aromatic compound content of the hydrocarbon feed material.

16. The process according to claim 1, wherein the bifunctional metal catalyst contains only one hydrogenating metal component.

17. A process for producing a middle distillate suitable as a diesel fuel, with improved low temperature properties and a low content of aromatic compounds, from a hydrocarbon feed as a starting material which comprises contacting said feed material in a single reaction step, in the presence of hydrogen, and at an elevated temperature and pressure, with a bifunctional catalyst which comprises:

a hydrogenating metal component which consists of one hydrogenating metal;

one molecular sieve; and a carrier for the simultaneous removal of aromatics and isomerization of paraffins.

* * * * *